US006109805A

United States Patent [19]

Ono et al.

[11] Patent Number: 6,109,805

[45] Date of Patent: Aug. 29, 2000

[54] RECORDING APPARATUS WITH A RECORDING PAPER MOUNTED IN AN OPEN/CLOSE COVER

[75] Inventors: Kazuyasu Ono; Hideo Kanbe; Tadashi Nonaka; Kanji Suzuki, all of Shizuoka, Japan

[73] Assignee: Star Micronics Co., Ltd., Shizuoka, Japan

[21] Appl. No.: 09/297,684

[22] PCT Filed: Oct. 29, 1997

[86] PCT No.: PCT/JP97/03939

§ 371 Date: May 6, 1999

§ 102(e) Date: May 6, 1999

[87] PCT Pub. No.: WO98/21041

PCT Pub. Date: Oct. 29, 1997

[30] Foreign Application Priority Data

| | | | |
|---|---|---|---|
| Nov. 8, 1996 | [JP] | Japan | 8-296722 |
| Nov. 8, 1996 | [JP] | Japan | 8-296723 |
| Nov. 8, 1996 | [JP] | Japan | 8-296724 |

[51] Int. Cl.[7] ..... B41J 11/26

[52] U.S. Cl. ..... 400/618; 400/613; 400/619; 400/594.1

[58] Field of Search ..... 400/613, 613.1, 400/615, 617, 618, 619, 594, 594.1, 703, 705

[56] References Cited

U.S. PATENT DOCUMENTS

| | | | |
|---|---|---|---|
| 5,077,614 | 12/1991 | Stemmle et al. | 358/296 |
| 5,411,342 | 5/1995 | Horie et al. | 400/613 |
| 5,516,219 | 5/1996 | Leonard et al. | 400/613 |

FOREIGN PATENT DOCUMENTS

| | | |
|---|---|---|
| 56-104084 | 8/1981 | Japan . |
| 62-150148 | 9/1987 | Japan . |
| 1-70558 | 5/1989 | Japan . |
| 1-174147 | 12/1989 | Japan . |
| 2-8781 | 3/1990 | Japan . |
| 4-42141 | 4/1992 | Japan . |
| 4-249174 | 9/1992 | Japan . |

OTHER PUBLICATIONS

Pending U.S. Application No. 09/297,766, filed May 7, 1999, entitled "Printer", by Kazuyasu Ono et al., located in Group Art Unit 2854.

*Primary Examiner*—John Hilten
*Assistant Examiner*—Dave Ghatt
*Attorney, Agent, or Firm*—Wenderoth, Lind & Ponack, L.L.P.

[57] ABSTRACT

A recording apparatus includes an apparatus body and an open/close cover mounted on the apparatus body so that the open/close cover can pivot between an open position and a close position on a pivot. A roll of recording paper is rotatably supported by the open/close cover, recording paper therefrom being conveyed through a conveying path. A recording device records information on recording paper from the roll of recording paper. The open/close cover is provided with braking force applying structure for applying braking force to the roll of recording paper. The roll of recording paper is pivoted in unison with the open/close cover by an effect of the braking force applying structure when the open/close cover is pivoted toward the close position, whereby the roll of recording paper is moved in a direction for rewinding the recording paper which is pulled from the roll of recording paper.

10 Claims, 10 Drawing Sheets

RECORDING APPARATUS WITH A RECORDING PAPER MOUNTED IN AN OPEN/CLOSE COVER

DESCRIPTION

1. Technical Field

The present invention relates to a recording apparatus for recording information on roll-like recording paper.

2. Background Art

Conventionally, a recording apparatus using roll-like paper as recording paper has been practically used widely. As a recording apparatus of this kind, there are a printer for printing on a receipt, a facsimile for recording signals transmitted, for example. Such an apparatus includes an apparatus body, a conveying path provided in the apparatus body, recording paper of a roll of recording paper which is conveyed through the conveying path, and recording means for recording information on the recording paper conveyed through the conveying path. An open/close cover is mounted on the apparatus body such that the cover can pivot between an open position and a close position about its pivot. The open/close cover is provided with recording paper holding means for supporting and holding the roll of recording paper such that the recording paper holding means can rotate about its rotation axis. The recording paper is pulled out from the roll of recording paper, and a tip end of the recording paper is conveyed through the conveying path as required.

A roll of recording paper used in this kind of recording apparatus generally includes a thin cylindrical core member, and is formed by winding long and narrow recording paper around this core member as required. When a used roll of recording paper is replaced by a new roll of recording paper, the open/close cover is first opened to its open position. Then, in a state in which the cover is held at the open position, the roll of recording paper (some length of recording paper may be remained, or there may be no recording paper and only the core member is remained depending upon cases) is removed from the recording paper holding means, and the new roll of recording paper is mounted on the recording paper holding means. After the new roll of recording paper is mounted, a tip end of the recording paper is pulled out from the roll of recording paper and is introduced into the conveying path, and the tip end is nipped by printing means or by a pair of conveying rollers which feeds the recording paper toward the printing means so that the recording paper can be fed. Thereafter, the open/close cover is positioned to the close position. In this manner, the new roll of recording paper can be mounted in place of the used roll of recording paper.

In this kind of recording apparatus, generally, when a new roll of recording paper is mounted, it is difficult to hold the recording paper introduced from this roll of recording paper into the conveying path in an appropriately pulled state, and the recording paper pulled out from the roll of recording paper is somewhat loose. The conventional recording apparatus is not provided with means for taking up the slack in the recording paper generated in this manner. Therefore, after the roll of recording paper is replaced, the recording paper is held in the conveying path in a somewhat loose state. If the recording is carried out on the recording paper in such a state, when the slack is taken up by feeding operation of the recording paper, impact force for rotating the roll of recording paper is applied to the recording paper, and there is a problem that the print on the recording paper surface is disordered by this impact force.

Further, in this kind of recording apparatus, the rotation center of the roll of recording paper (in generally, the roll of recording paper is substantially uniformly wound in the form of a cylinder, and thus the center of gravity thereof is located at the rotation center of the roll of recording paper) is different from the pivot of the open/close cover, and due to this fact, the following problem is caused. That is, in the case of the conventional recording apparatus, the pivot of the open/close cover is disposed at a rear end of the apparatus body, and the rotation center of the roll of recording paper is disposed forward of the pivot by a distance in some degree. Therefore, when the open/close cover is opened from the close position toward the open position, or when the open/close cover is closed from the open position toward the close position, the roll of recording paper acts as a load at the time of pivoting, and the open/close cover can not be opened or closed smoothly.

Especially in the case of an apparatus which is defined such that the open/close cover is largely opened and the roll of recording paper is angularly moved so as to exceed the uppermost position, during the open/close cover is closed from the open position toward the close position, the roll of recording paper acts in this closing direction, i.e., in the dropping direction from the point where the cover exceeds the upper most position and starts moving downward, and hence the force acting in the closing direction is abruptly increased. The force in the closing direction is increased as the roll of recording paper to be used is greater, and as the distance between the pivot of the open/close cover and the rotation center of the roll of recording paper is greater. If the force in the closing direction becomes great, the open/close cover is prone to drop toward the close position at the time of closing operation, the open/close cover is prone to be damaged, and there is a danger that the user catches his or her finger.

Further, as an apparatus for printing slip paper (generally called as "a sheet of recording paper") which is called as a slip such as order slip and receipt, there is a conventionally known recording apparatus in which the sheet of recording paper is manually supplied for printing (e.g., Japanese Unexamined Utility Model Publication JP-U 62-150148 (1987), Japanese Examined Utility Model Publication JP-Y22-8781 (1990)). This kind of recording apparatus includes an apparatus body, a conveying path defined for the apparatus body, conveying means for conveying the sheet of recording paper through the conveying path, and recording means disposed in the conveying path. An insertion/discharge port is disposed at one end of the conveying path, the sheet of recording paper is inserted to the conveying path through the insertion/discharge port, the inserted sheet of recording paper is subjected to printing on its surface by the recording means while being conveyed through the conveying path, and the printed sheet of recording paper is conveyed in a direction opposite from the inserting direction, and is discharged from the insertion/discharge port. The conveying path is provided at its side with a slit, and the sheet of recording paper can also be fed to the conveying path through this slit.

Sheet detecting means for detecting the sheet of recording paper is disposed above the insertion/discharge port. The sheet detecting means detects the sheet of recording paper to be inserted or discharged through the insertion/discharge port, and the conveying means is controlled as required based on a detection signal from the sheet detecting means.

In this kind of recording apparatus, the sheet of recording paper to be inserted and discharged through the insertion/discharge port is conveyed in the inserting direction and the discharging direction opposite from the inserting direction passing below the sheet detecting means. When the sheet of recording paper is inserted into the conveying path, the tip end of the sheet of recording paper is passed below the sheet detecting means and introduced to the insertion/discharge port by hand and thus, the sheet of recording paper can be inserted to the conveying path. On the other hand, when the printed sheet of recording paper is discharged outside through the insertion/discharge port, if the sheet of recording paper is curved upward and the curving degree is relatively large, there is an unfavorable possibility that the tip end of the sheet of recording paper is not introduced below the sheet detecting means but the tip end is fed above the sheet detecting means. If the sheet of recording paper is fed above the sheet detecting means, the discharging operation is hindered by the sheet detecting means, the recording paper is not discharged outside through the insertion/discharge port, and a paper jam is caused within the apparatus body.

In order to prevent such a paper jam due to the sheet detecting means, the conveyance of the sheet of recording paper may be controlled such that the rear end of the sheet of recording paper (rear end when the sheet of recording paper is conveyed in the inserting direction) is not passed through the sheet detecting means. However, if such a control is carried out, a space between the recording means and the sheet detecting means becomes a non-printable region, and in the case of an apparatus in which such a space is set great, the non-printable region becomes great, and a recording region to the recording paper is largely limited.

It is an object of the present invention to provide a recording apparatus capable of taking up the slack which is prone to be generated when a new roll of recording paper is mounted without adding a new member to a cover and a roll paper holding mechanism.

It is another object of the invention to provide a recording apparatus capable of smoothly open and close the open/close cover.

It is still another object of the invention to provide a recording apparatus capable of reliably introducing the sheet of recording paper below the sheet detecting means with a relatively simple structure, and capable of reducing the non-recordable region even when the above-described control is carried out.

DISCLOSURE OF INVENTION

The present invention provides a recording apparatus comprising:

an apparatus body;

an open/close cover mounted on the apparatus body so as to pivot between an open position and a close position on a pivot thereof;

a conveying path provided in the apparatus body;

a roll of recording paper supported by the open/close cover rotatably about a rotation axis thereof, recording paper from the roll of recording paper being conveyed through the conveying path; and recording means for recording information on the recording paper conveyed through the conveying path, wherein the open/close cover is provided with braking force applying means for applying braking force to the roll of recording paper, and the roll of recording paper is pivoted in unison with the open/close cover by an effect of the braking force applying means when the open/close cover is pivoted from the open position to the close position, whereby the roll of recording paper is rotated in a direction for rewinding the recording paper pulled out therefrom.

In this recording apparatus, since the open/close cover is provided with the braking force applying means for applying the braking force to the roll of recording paper, when the roll of recording paper is replaced and the open/close cover is pivoted toward the close position, the roll of recording paper is rotated in unison with the open/close cover. Then, the roll of recording paper is moved in the direction for rewinding the recording paper pulled out from the roll of recording paper by the pivoting of the roll of recording paper. Therefore, even if some slack is generated when the roll of recording paper is replaced, such slack is taken up by the rotation of the roll of recording paper.

According to the invention, the open/close cover is provided with recording paper holding means for supporting the roll of recording paper rotatably about a rotation axis thereof extending substantially in parallel to the pivot, and the pivot of the open/close cover and the rotation axis of the roll of recording paper substantially coincide with each other.

With this recording apparatus, since the pivot of the open/close cover and the rotation axis of the roll of recording paper substantially coincide with each other, the open/close cover can be opened and closed smoothly. Further, since the pivot and the rotation axis substantially coincide with each other, if the open/close cover is pivoted from the open position to the close position, the roll of recording paper is reliably rotated in a direction for rewinding the recording paper pulled out therefrom, and the slack is taken up by such a rotation.

Further, in the invention the roll of recording paper comprises a core member and recording paper wound therearound, and the braking force applying means acts on the core member to apply the braking force to the roll of recording paper.

With this recording apparatus, since the braking force applying means acts on the core member of the roll of recording paper to apply the braking force to the roll of recording paper, constant braking force can be applied irrespective of service conditions of the recording paper.

Further, in the invention the recording means includes a print head and an opposing member to be pushed against the print head, and nip force of the recording paper by the print head and the opposing member is greater than the braking force applied to the roll of recording paper by the braking force applying means.

With this recording apparatus, since the nip force by the print head and the opposing member is greater than the braking force of the braking force applying means, when the slack of the recording paper is small, the roll of recording paper is rotated relative to the open/close cover after the slack is taken up, and the nipping condition of the recording paper by the print head and the opposing member should not substantially be varied.

Further, the invention provides a recording apparatus comprising:

an apparatus body;

an open/close cover mounted to the apparatus body so as to pivot between an open position and a close position on a pivot thereof;

a conveying path provided in the apparatus body;

a roll of recording paper to be conveyed through the conveying path; and recording means for recording information on the recording paper conveyed through the conveying path, wherein the roll of recording paper is supported by the open/close cover rotatably about a rotation axis thereof extending substantially in parallel to the pivot, and the pivot of the open/close cover and the rotation axis of the roll of recording paper substantially coincide with each other.

With this recording apparatus, since the pivot of the open/close cover and the rotation axis of the roll of recording paper supported by the open/close cover substantially coincide with each other, even if the open/close cover is pivoted between the open position and the close position, the roll of recording paper does not substantially act as a load of the pivoting movement, and the open/close cover can be smoothly opened and closed.

In the invention, the open/close cover is provided with a discharge opening for discharging the recording paper of the roll of recording paper conveyed through the conveying path, and a guide rib for guiding the recording paper of the roll of recording paper discharged through the discharge opening outside of the apparatus body.

With this recording apparatus, since the open/close cover is provided with the guide rib for guiding the recording paper form the roll of recording paper outside from the apparatus body, a tip end of the recording paper of the roll of recording paper discharged from the discharge opening is reliably prevented from entering a clearance between the apparatus body and the open/close cover.

The invention provides a recording apparatus comprising:

an apparatus body;

a conveying path defined in the apparatus body;

conveying means for conveying a sheet of recording paper in an inserting direction and a discharging direction opposite from the inserting direction through an insertion/discharge port provided at one end of the conveying path;

recording means disposed in the conveying path, for recording on the sheet of recording paper conveyed through the conveying path; and sheet detecting means for detecting the sheet of recording paper, wherein the sheet detecting means is disposed above the insertion/discharge port, the sheet of recording paper being inserted into and discharged from the conveying path passing below the sheet detecting means, the apparatus body is provided with an open/close cover which can pivot between a close position and an open position on a pivot thereof, the open/close cover being provided with a guide rib for guiding the sheet of recording paper, and when the open/close cover is held at the close position, the guide rib is located above the insertion/discharge port in a vicinity thereof to define a portion of the conveying path, and introduces the sheet of recording paper conveyed in the discharging direction through the conveying path below the sheet detecting means.

With this recording apparatus, the open/close cover which is mounted on the apparatus body so as to pivot is provided with the guide rib, and when the open/close cover is positioned to the close position, the guide rib is located above the insertion/discharge port of the conveying path to define a portion of the conveying path. Therefore, the tip end of the sheet of recording paper in the discharging direction conveyed toward the insertion/discharge port is reliably guided by the guide rib and introduced below the sheet detecting means, and the paper jam is prevented. Further, since the guide rib is disposed upstream the sheet of member as viewed in the discharging direction of the recording paper, the recording paper is reliably discharged through the insertion/discharge port by controlling the conveying means such that the tip end of the sheet of recording paper in the discharging direction is located below the guide rib. Therefore, the non-recordable region is reduced by the existence of the guide rib, and the limitation of record on the sheet of recording paper is reduced.

Further, in the invention the recording means is disposed inside the open/close cover in a vicinity thereof, the sheet detecting means is disposed outside the open/close cover, and when the open/close cover is pivoted to the open position, the apparatus body is partially opened, whereby the recording means is largely exposed outside, and when the open/close cover is pivoted to the close position, the recording means is covered with the open/close cover and the guide rib of the open/close cover defines the portion of the conveying path between the recording means and the sheet detecting means.

With this recording apparatus, the recording means is disposed inside the open/close cover in the vicinity thereof, and when the open/close cover is located at the open position, the recording means is largely exposed outside. Therefore, utilizing the opening which is opened by positioning the open/close cover at the open position, parts of the recording means such as a print ribbon can easily be replaced. Further, when the open/close cover is positioned at the close position, a portion of the conveying path is defined between the recording means and the sheet detecting means. Therefore, the sheet of recording paper conveyed from the recording means to the insertion/discharge port is guided by the guide rib and introduced below the sheet detecting means.

In the invention the guide rib is provided with an inclining guide surface downwardly inclining in the discharging direction, and the sheet of recording paper conveyed in the discharging direction is guided by the inclining guide surface and introduced below the sheet detecting means.

With this recording apparatus, since the guide rib is provided with the inclining guide surface which downwardly inclines, when the sheet of recording paper is conveyed in the discharging direction, even if the tip end of the sheet of recording paper is curved in the discharging direction, the tip end in the discharging direction is guided by the inclining guide surface and is reliably introduced below the sheet detecting means.

Further, in the invention the sheet detecting means comprises a combination of light-emitting means for emitting light and light-receiving means for receiving light from the light-emitting means, one of the light-emitting means and the light-receiving means is disposed above the insertion/discharge port, while the other of the light-emitting means and the light-receiving means is disposed below the insertion/discharge port, the one of the light-emitting means and the light-receiving means is covered with a sensor cover, and the sensor cover is provided at a lower end thereof with a first inclining surface for introducing the sheet of recording paper moved in the inserting direction below the sensor cover, and a second inclining surface for introducing the sheet of recording paper moved in the discharging direction below the sensor cover.

With this recording apparatus, the sheet detecting means comprises the combination of the light-emitting means and the light-receiving means, one of them disposed in the insertion/discharge port is covered with the sensor cover, and the sensor cover is provided at its lower end with the first and second inclining surfaces. Therefore, when the sheet of recording paper is inserted toward the insertion/discharge port, the tip end of the sheet of recording paper in the inserting direction is guided by the first inclining surface and introduced below the sensor cover, and is passed below the sensor cover and inserted into the conveying path below the sensor cover. When the sheet of recording paper is conveyed in the discharging direction, the tip end of the sheet of recording paper in the discharging direction is guided by the second inclining surface and introduced below the sensor cover, and is passed below the sensor cover and discharged outside the apparatus body.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
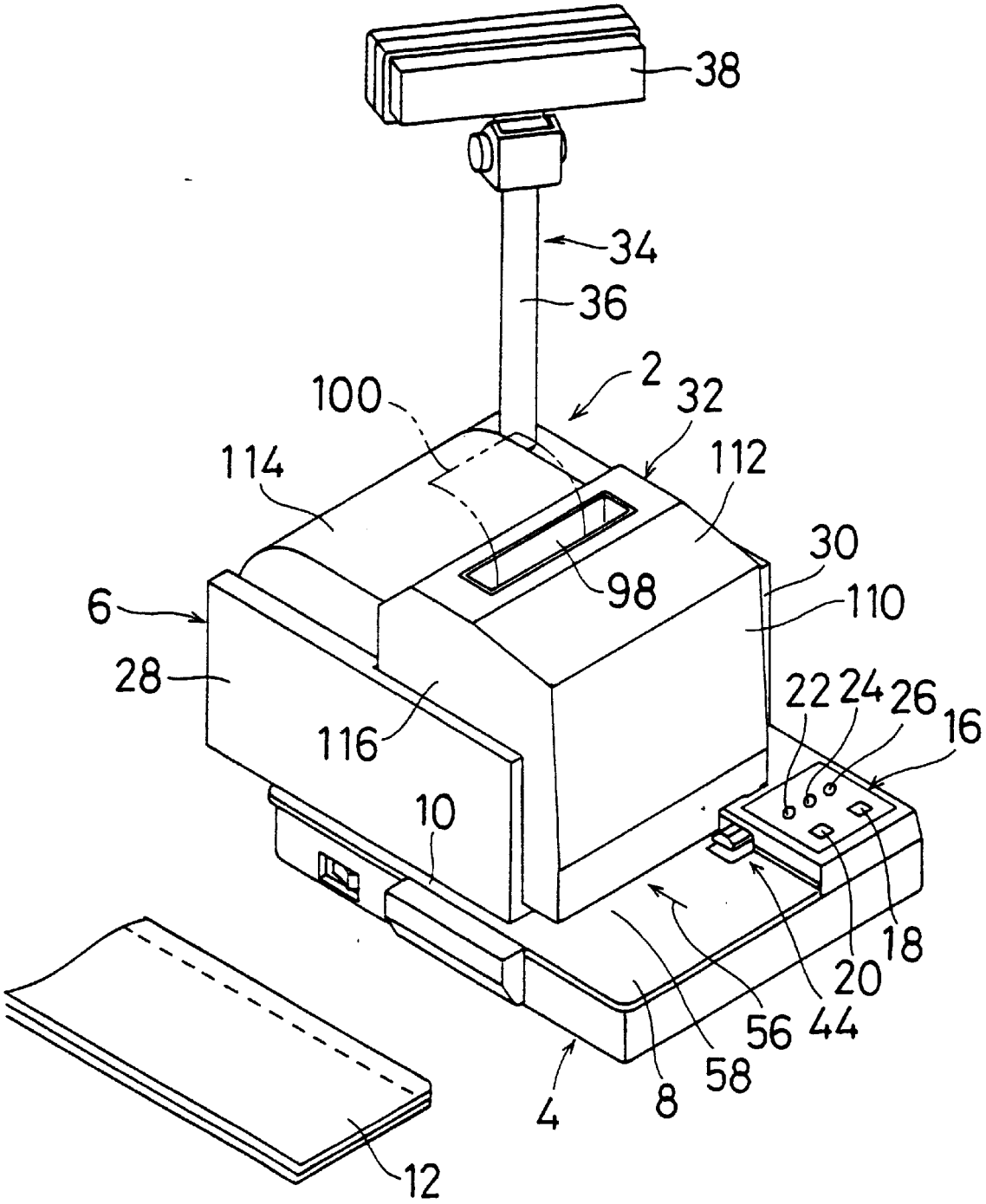
FIG. 1 is a perspective view of a preferred embodiment of a recording apparatus of the invention as viewed from front side of the apparatus.
Figure 2:
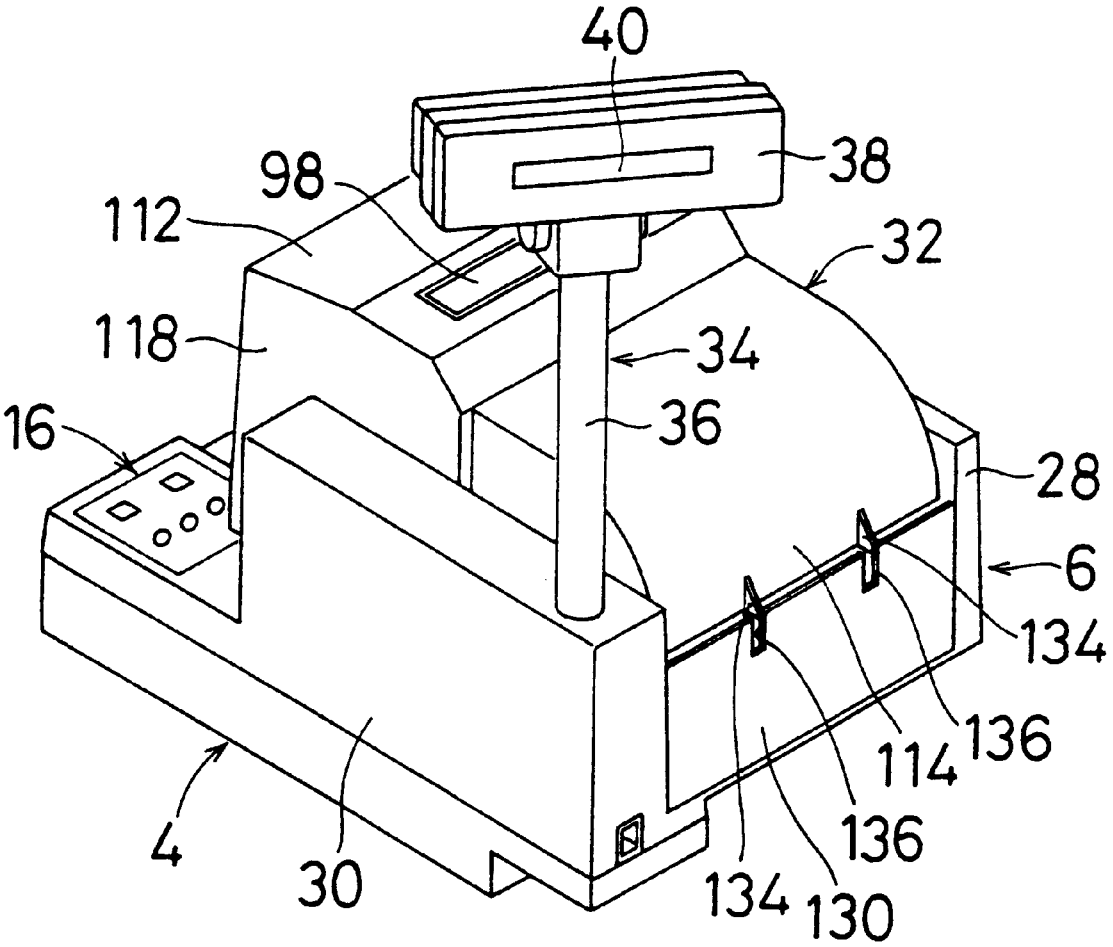
FIG. 2 is a perspective view of the recording apparatus shown in FIG. 1 as viewed from back side thereof.

A preferred embodiment of a recording apparatus of the present invention will be explained with reference to the accompanying drawings below. In FIGS. 1 and 2, the illustrated recording apparatus is provided with an apparatus body 2. The apparatus body 2 comprises a lower housing 4 placed on a desk or the like for example, and an upper housing 6 mounted on the lower housing 4. The lower housing 4 is provided with a table 8, the table 8 is substantially horizontally extended from a front end (right lower portion in FIG. 1) toward a rear end (left upper portion in FIG. 1). A long and narrow slit 10 opening toward one side (left lower side in FIG. 1) is provided between the lower housing 4 and the upper housing 6, and the table 8 is extended within the slit 10. A slip 12 comprising a plurality of sheets of copy paper or the like is positioned on an upper surface of the table 8 through the slit 10, and while the slip 12 is conveyed along the table 8, predetermined recording of information such as printing is carried out on a surface of the slip 12. The slip 12 as a sheet of recording paper is a multiple form for a credit card, for example, and is used when the necessary number of duplicates for a store, a customer, a store clerk and the like are prepared at the same time.

An operation panel 16 is disposed on a front right portion of the lower housing 4. The operation panel 16 is provided with switches 18 and 20 for selecting the type of print, and various display lamps 22, 24 and 26. The switch 18 is for selecting the print to the slip 12, and by pushing this switch 18, it is possible to print on the slip by first recording means (which will be described later). The switch 20 is for selecting the print on a roll of recording paper (which will be described later), and by pushing this switch 20, it is possible to print on the roll of recording paper by second recording means (which will be described later). The lamp 22 shows, by continuously lighting, that the recording apparatus is in power on state, and shows, by blinking on and off, that the slip is being conveyed. The lamp 24 shows, by continuously lighting, that the slip 12 is being discharged, and shows, by blinking on and off, that the recording apparatus has a trouble. The lamp 26 shows, by continuously lighting, that the slip 12 is being released, and shows, by blinking on and off, that the recording apparatus is in off-line with an external host apparatus such as a host computer.

The upper housing 6 includes side wall covers 28 and 30 disposed on opposite sides of the upper housing 6, and an open/close cover 32 is disposed between the side wall covers 28 and 30. The open/close cover 32 is mounted on the upper housing 6 such that the open/close cover 32 can pivot between a close position shown in FIGS. 1 and 2 and an open position shown in FIG. 4. When the open/close cover 32 is in the close position, the open/close cover 32 covers a front surface, a ceiling surface, au upper portion of a rear surface and upper portions of the opposite side surfaces of the upper housing 6, and a roll of recording paper mounted thereto which will be described later is located at a predetermined position. On the other hand, when the open/close cover 32 is pivoted to the open position, the front surface and the ceiling surface of the upper housing 6 are opened, so that the roll of recording paper can easily be replaced as will be described later.

In the present embodiment, the upper housing 6 is provided at its right rear portion with display means 34 for displaying data which is designated by the external host apparatus. The display means 34 includes a supporting rod 36 extended upward from the upper housing 6, and the supporting rod 36 is provided at its upper end with a display portion 38. A rectangular display panel 40 is disposed on a surface of the display portion 38, and data from the host apparatus is displayed on this display panel 40.

Next, the outline of the structure of the above-described recording apparatus will be explained with mainly reference to FIG. 3. The table 8 of the lower housing 4 is provided at its predetermined portions with a plurality of openings. Sheet detecting means 44 is provided in correspondence with an opening 42. The sheet detecting means 44 comprising a photosensor detects a slip on the table 8. This sheet detecting means 44 and the structure related thereto will be described in detail later. A pair of rollers 48 and first print means 50 are disposed in correspondence with an opening 46. The pair of rollers 48 comprises a pair of rollers 52 and 54, and when the slip 12 (FIG. 1) is conveyed in the inserting direction shown with the arrow 56, the pair of rollers 48 is rotated in the direction shown with the arrow, and when the slip 12 is conveyed toward an insertion/discharge port 58, the pair of rollers 48 is rotated in the opposite direction from the direction shown with the arrow. In the present embodiment, the first print means 50 is configured by an impact type print means, and comprises a print unit 60 including a print head and a platen opposed to the print unit 60. As can be understood in FIG. 4, a ribbon cassette 64 is detachably mounted on the print unit 60. Guide plates 66 and 68 are disposed above the table at a distance from each other in the conveying direction of the slip 12. Since the printing apparatus is structured in this manner, the table 8, the roller 52 and the platen 62 are provided on the lower housing 4 and define the lower side of a first conveying path 70 for conveying the slip 12. The roller 54, the print unit 60 and the guide plates 66 and 68 are provided on the upper housing 6 and define the upper side of the first conveying path 70. The first conveying path 70 is disposed in correspondence with the slit 10 between the lower housing 4 and the upper housing 6.

In the present embodiment, second print means 72 is provided above the first print means 50. The second print means 72 is configured by thermal-recording type print means, and comprises a print unit 78 including a print head 74 having a line-type thermal head, and a platen roller 76 opposed to the print head 74. The platen roller 76 is rotated in the direction shown with a broken line arrow. The platen roller 76 is pushed against the print head 74 by a biasing member (not shown) such as a spring, and a second conveying path 80 is extended between the print head 74 and the platen roller 76. On the upstream end of the second conveying path 80, is disposed the roll of recording paper 82 which is replaceably mounted on the open/close cover 32 as will be described later. A pair of guide plates 84 and 86 are mounted on the print unit 78 at a predetermined distance from each other. A cutter unit 88 is disposed above the second print means 72. The cutter unit 88 includes a fixed blade 90 and a movable blade 92 which is movable toward the fixed blade 90, whereby the recording paper from the roll of recording paper 82 is cut by predetermined length. The cutter unit 88 is provided with a pair of guide plates 94 and 96 at a predetermined distance from each other. In this recording apparatus, in connection with the fact that the second conveying path 80 extends upward, the open/close cover 32 is provided at its upper surface with a second discharge port 98. With this structure, the guide plate 84, the print head 74, the guide plate 94 and the fixed blade 90 define one side of the second conveying path 80 for conveying the recording paper from the roll of recording paper 82. The guide 86, the platen roller 76, the guide plate 96 and the movable blade 92 define the other side of the second conveying path 80. A tip end of recording paper 100 pulled out from the roll of recording paper 82 is extended from the lower side of the roll of recording paper 82 toward the side where the open/close cover 32 is opened, i.e., toward the second print means 72 at the front and upper portion of the apparatus body, and is introduced to the second conveying path 80.

In this recording apparatus, when printing is carried out on the slip 12 (FIG. 1) as a sheet of recording paper, the slip 12 is conveyed through the first conveying path 70, and while the slip 12 is conveyed through the first conveying path 70, a predetermined print is recorded on a surface of the slip 12 by the first print means 50, and the slip on which the print has been completed is discharged out from the apparatus body 2 through the insertion/discharge port 58. When printing is carried out on the roll of recording paper 82, the recording paper pulled out from the roll of recording paper 82 is conveyed through the second conveying path 80, and while the recording paper is conveyed through the second conveying path 80, a predetermined print is recorded on a surface of the recording paper by the second print means 72, and is discharged out from the apparatus body 2 from the second discharge port 98 of the open/close cover 32 as shown with the phantom line 100. Such a record on the roll of recording paper 82 can be used as a receipt to be handed in to the customer. When printing is carried out on both the slip 12 and the roll of recording paper 82, the slip 12 is conveyed through the first conveying path 70, and the recording paper of the roll of recording paper 82 is conveyed through the second conveying path 80. In this recording apparatus, the first print means 50 functions as recording means for recording the print on the sheet of recording paper, and the second print means 72 functions as recording means for recording the print on the roll of recording paper 82.

Figure 4:
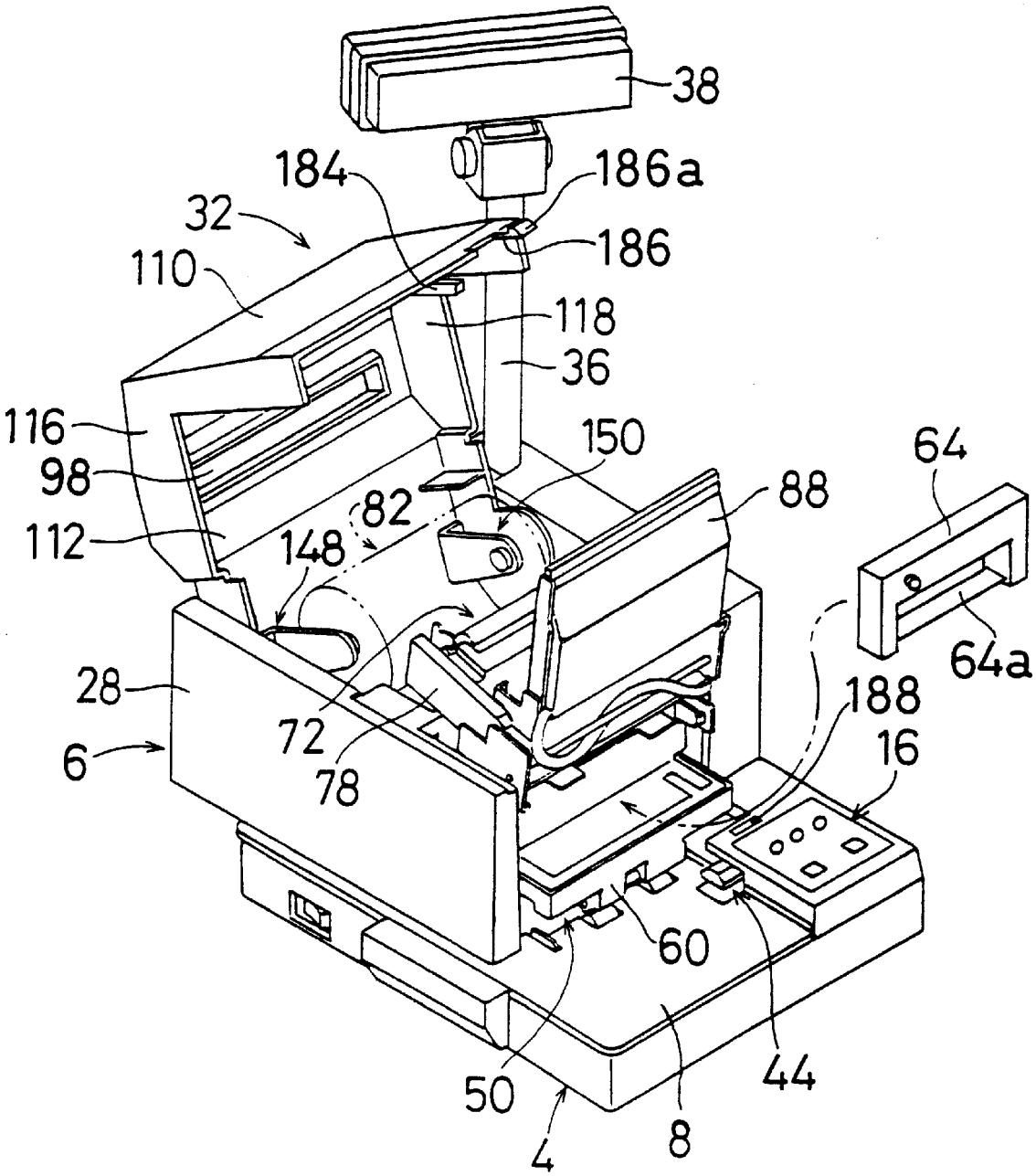
FIG. 4 is a perspective view as viewed from front side of a state in which an open/close cover of the recording apparatus shown in FIG. 1 is positioned at its open position.
Figure 5:
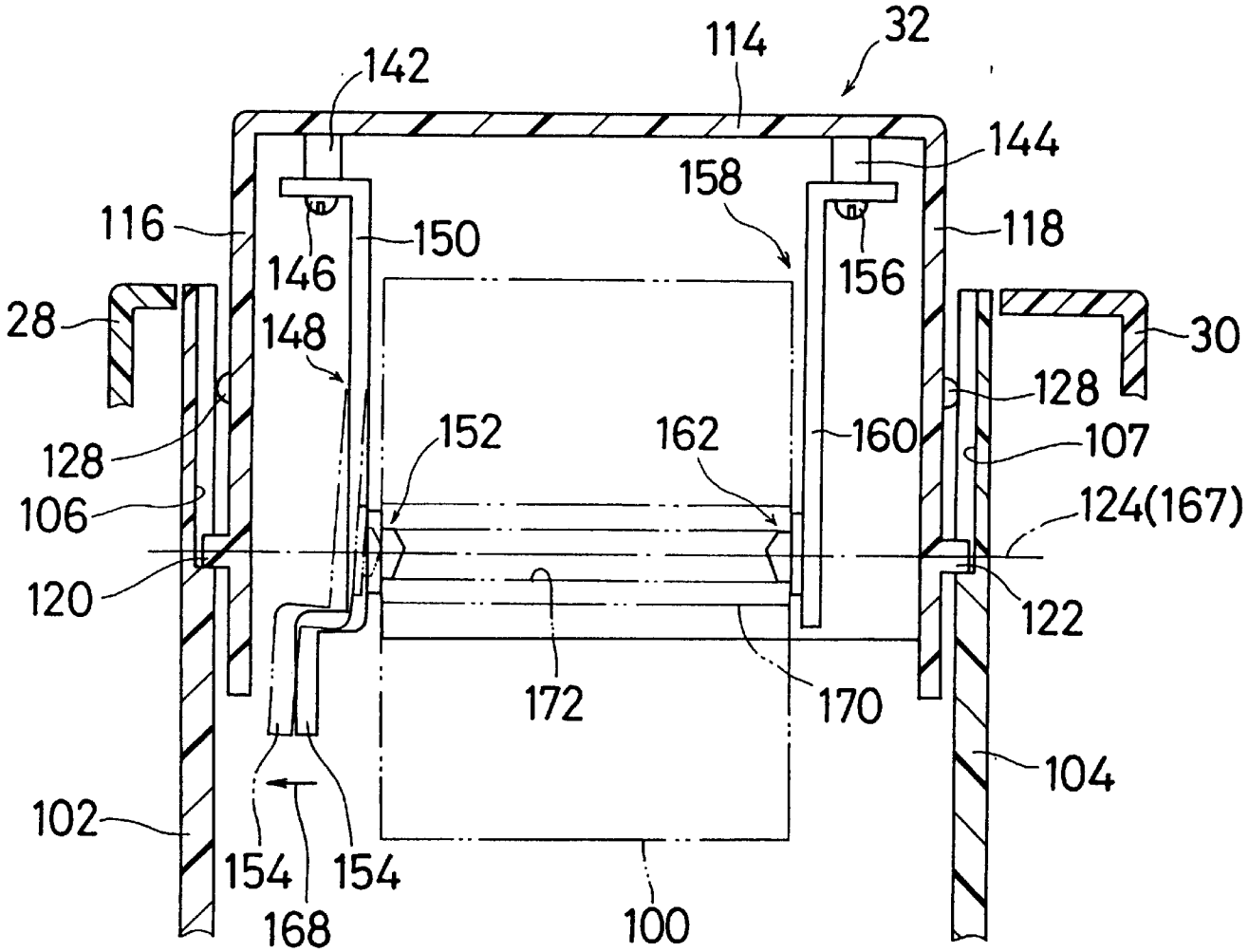
FIG. 5 is a sectional view showing the open/close cover and its periphery of the recording apparatus shown in FIG. 1.

Referring to FIGS. 4 and 5, an opening and closing structure of the open/close cover 32 and a supporting structure of the roll of recording paper 82 will be explained next. A pair of upper supporting walls 102 and 104 are provided inside the opposite side wall covers 28 and 30 (FIGS. 1 and 2) of the upper housing 6 at a distance from each other in the lateral direction (the direction from lower left to upper right in FIG. 4, and the lateral direction in FIG. 5). These upper supporting walls 102 and 104 are formed separately from the side wall covers 28 and 30, but may be formed integrally with the side wall covers 28 and 30. The upper supporting walls 102 and 104 are respectively formed at their inner surfaces with guide recesses 106 and 107 extended straightly downwardly from the upper ends, and the guide recesses 106 and 107 are provided at their lower ends with circle recesses 108 and 109 (see FIG. 8 also). On the other hand, the open/close cover 32 includes a front wall 110 for covering a front surface of the upper housing 6, a ceiling wall 112 for covering a ceiling surface of the upper housing 6, an arc rear wall 114 (FIGS. 2 and 4) for covering a rear portion of the ceiling surface and a rear surface of the upper housing 6, and opposite side walls 116 and 118 for covering upper portions of opposite side surfaces of the upper housing 6. The opposite side walls 116 and 118 are integrally provided at their rear outer surface with supporting projections 120 and 122 projecting opposite sides. Each of the supporting projections 120 and 122 is formed into a short cylindrical shape corresponding to each of the circle recesses 108 and 109, and the portions of the supporting projections 120 and 122 that are opposed are notched straightly. Short width W1 of each of the supporting projections 120 and 122 is set slightly smaller than width W2 of each of the guide recesses 106 and 107 (FIG. 8).

Figure 6:
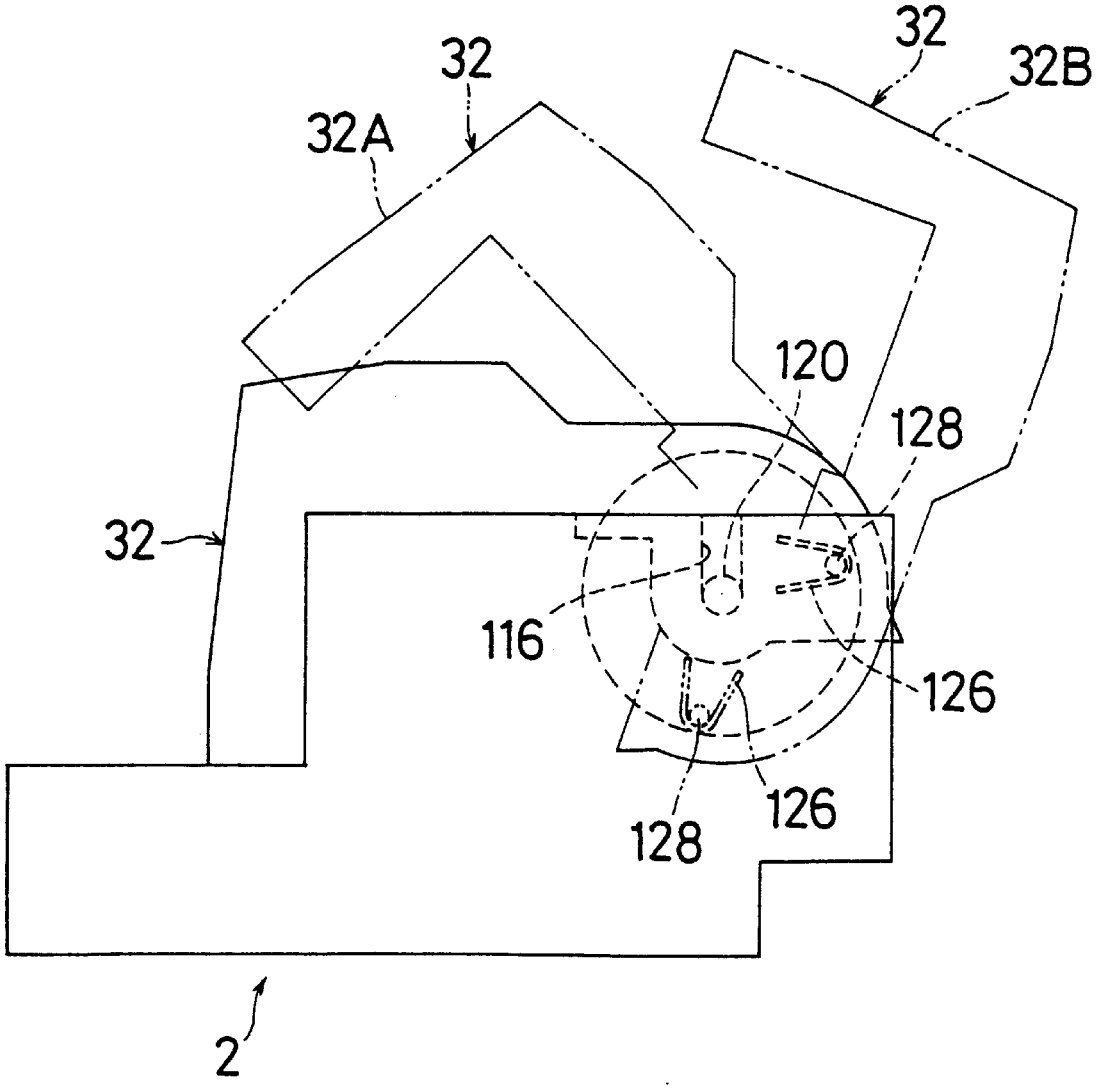
FIG. 6 is a schematic explanatory view for explaining opening and closing movements of the open/close cover of the recording apparatus shown in FIG. 1.
Figure 8:
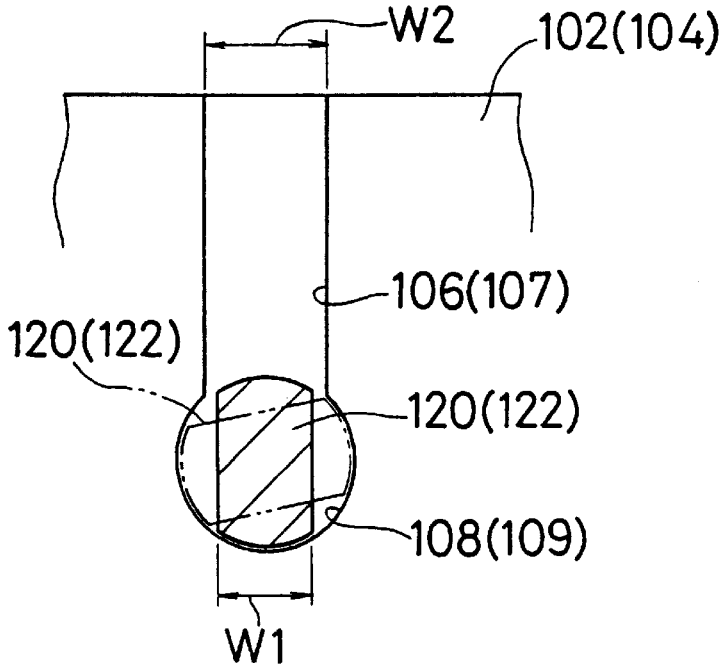
FIG. 8 is a partially enlarged sectional view for explaining the mounting operation of the open/close cover to an upper housing of the recording apparatus shown in FIG. 1.

When the open/close cover 32 is moved to the position shown with the phantom line 32A in FIG. 6, i.e., to about the midpoint position the close position shown with the solid line in FIG. 6 (position shown in FIGS. 1 to 3) and the open position shown with the phantom line 32B (the position shown in FIG. 4), the guide recesses 106 and 107 of the upper supporting walls 102 and 104, and the supporting projections 120 and 122 of the side walls 116 and 118 of the open/close cover 32 are positioned at the positional relation shown in FIG. 8, i.e., at the positional relation where the supporting projections 120 and 122 coincide with the guide recesses 106 and 107 and become narrow and long in the vertical direction. Therefore, the supporting projection 120 and 122 can be positioned within the circle recesses 108 and 109 through the guide recesses 106 and 107 of the side walls 116 and 118, and with such positioning, the open/close cover 32 is rotatably mounted between the side walls 116 and 118 of the upper housing 6. In a state in which the supporting projections 120 and 122 are mounted on the circle recesses 108 and 109, the center axes of the supporting projections 120 and 122 are extended in the lateral direction of the apparatus body 2, and the open/close cover 32 can be pivoted on the center axis of the supporting projections 120 and 122 as a pivot 124 thereof (FIG. 5) between the close position and the open position. When the open/close cover 32 is pivoted to the close position (or the open position), as shown with the phantom line in FIG. 8, the opposite ends of the supporting projections 120 and 122 are located within the circle recesses 108 and 109, and the supporting projections 120 and 122 are prevented from being come off the circle recesses 108 and 109. Further, in the above-described positional relation, since the supporting projections 120 and 122 match with the guide recesses 106 and 107, the supporting projections 120 and 122 can be moved upward through the guide recesses 106 and 107, and by moving the supporting projections 120 and 122 in this manner, the open/close cover 32 can be removed from the upper housing 6.

The side walls 116 and 118 of the open/close cover 32 are respectively provided integrally at their rear portions with resilient pieces 126 (only the resilient piece provided on the side wall 116 is shown in FIG. 6) by providing U-shaped cut grooves. Each of the resilient pieces 126 is provided at its tip end with semicircular projections 128 projecting outward (two of the projections are shown in FIG. 5). The projection 128 of the resilient piece 126 provided on the one side wall 116 is pushed against an inner surface of the upper supporting wall 102 by the resilience of the resilient piece 126 itself, and the projection 128 of the resilient piece 126 provided on the other side wall 118 is pushed against an inner surface of the other upper supporting wall 104 by the resiliency of the resilient piece 126 itself. Therefore, the friction force applied between the semicircular projections 128 and the upper supporting walls 102 and 104 acts as the braking force when the open/close cover 32 is pivoted, appropriate pivoting force is required for pivoting the open/close cover 32, a rotation due to the own weight of the open/close cover 32 is prevented, so that the safety is improved. This braking force can be adjusted by varying the size of the projection 128, i.e., the degree of the deformation of the resilient piece 126.

In the present embodiment, when the open/close cover 32 is positioned at the close position, as understood in FIG. 1, a part of a lower end of the front wall 110 abuts against an upper surface (upper surface in the vicinity of the portion where the operation panel 16 is provided) of the lower housing 4, thereby preventing the open/close cover 32 from pivoting exceeding the close position. The open/close cover 32 is provided with a lock member (which will be described later) for locking the open/close cover 32 to the close position. On the other hand, when the open/close cover 32 is positioned at the open position, as understood in FIGS. 2 to 4, a portion of the arc rear wall 114 abuts against an upper edge of a rear wall 130 of the upper housing 6, thereby preventing the open/close cover 32 from pivoting exceeding the close position.

Figure 3:
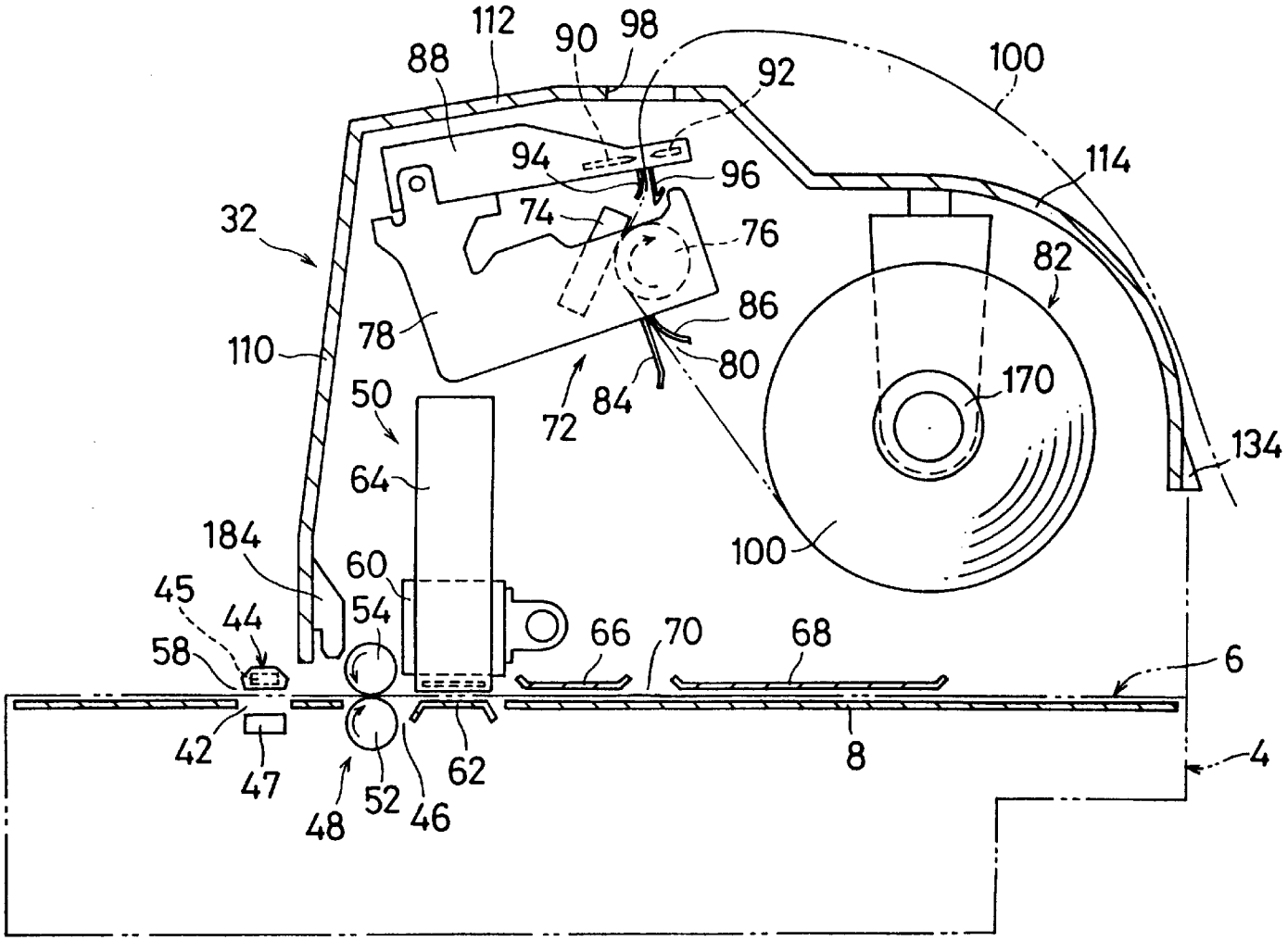
FIG. 3 is a sectional view showing outline of the structure of the recording apparatus shown in FIG. 1.

In this embodiment, as shown in FIGS. 2 and 3, a lower end of the arc rear wall 114 of the open/close cover 32 is integrally provided with a pair of guide ribs 134 at a distance from each other in the lateral direction (the direction from lower left to upper right in FIG. 2, and the direction perpendicular to a paper surface in FIG. 3). The pair of guide ribs 134 is of approximately triangle shape, and is positioned slightly above the upper edge of the rear wall 130 of the upper housing 6 when the open/close cover 32 is at the close position. An inclining upper surface of each of the guide ribs 134 is obliquely extended straightly downward from an outer surface of the open/close cover 32 above the upper edge of the rear wall 130 to a rear portion of the rear wall 130. When such guide ribs 134 do not exist, the recording paper 100 discharged through the discharge port 98 of the open/close cover 32 is moved along the upper surface of the open/close cover 32, and there is a fear that the tip end of the recording paper 100 enters into the clearance between the arc rear wall 114 of the open/close cover 32 and the rear wall 130 of the upper housing 6. Whereas, if the guide ribs 134 are provided as in the present embodiment, the tip end of the recording paper 100 discharged through the discharge port 98 is introduced outside the rear wall 130 of the lower housing 4 along the upper surfaces of the guide ribs 134, and the tip end of the recording paper 100 is reliably prevented from entering the clearance.

In the present embodiment, in order to allow the open/close cover 32 to pivot toward the open position, the upper end of the rear wall 130 of the upper housing 6 is formed with rectangular notches 136 (FIG. 2) in correspondence with the guide ribs 134. Therefore, when the open/close cover 32 is pivoted, the guide ribs 134 are moved through the notches 136. In order to introduce the recording paper 100 outside the rear wall 130 more reliably, it is preferable to provide three or more guide ribs 134 and notches 136 at a distance from each other in the lateral direction.

Figure 7:
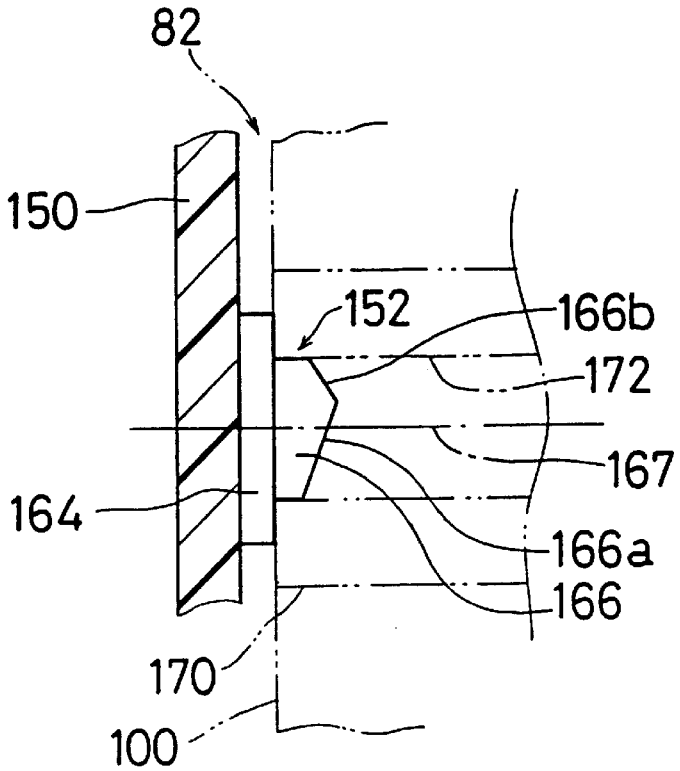
FIG. 7 is an enlarged sectional view showing recording paper supporting portion and its periphery of the open/close cover shown in FIG. 5.

Next, referring to FIGS. 3, 4 and 5, a supporting structure of the roll of recording paper 82 will be explained. An inner surface of the arc rear wall 114 of the open/close cover 32 is provided with a pair of mounting projections 142 and 144 at a distance from each other in the lateral direction (the lateral direction in FIG. 5). A supporting member 148 is mounted, by a mounting screw 146, to the mounting projection 142 which is disposed at an inner side of the side wall 116. The supporting member 148 includes a body portion 150 extended from the mounting projection 142 downward as viewed in FIG. 5. The body portion 150 is provided at its tip end with a recording paper supporting portion 152. The supporting member 148 is integrally provided with an operation portion 154 extended from the tip end of the body portion 150 to draw an approximately L-shape. A supporting member 158 is mounted, by a mounting screw 156, to the mounting projection 144 disposed at an inner side of the side wall 118. The supporting member 158 includes a body portion 160 extended from the mounting projection 144 downward as viewed in FIG. 5, and the body portion 160 is provided at its tip end with a recording paper supporting portion 162. The recording paper supporting portions 152 and 162 of the supporting members 148 and 158 have substantially the same structures and thus, one of the recording paper supporting portions 152 will be explained with reference to FIG. 7 also. In FIG. 7, the recording paper supporting portion 152 includes a first circular projection 164 which is mounted on an inner surface of a tip end of the body portion 150. The first projection 164 projects inward, and a tip end surface of the first projection 164 is concentrically provided with a circular second projection 166 which projects further inward. The center axis 167 (FIG. 7) of the second projection 166 of the supporting members 148 and 158 is extended in the lateral direction of the apparatus body 2, and the center axis 167 substantially coincides with the pivot 124 of the open/close cover 32 as shown in FIG. 5. Each of the supporting members 148 and 158 can be formed of synthetic resin in one piece, and by forming the supporting members in this manner, the supporting members 148 and 158 themselves can assume slight resilience. Since the recording apparatus is structured as described above, if the operation portion 154 of the supporting member 148 is pushed outward as shown with the arrow 168, the supporting member 148 is slightly deformed outward as shown with the phantom line in FIG. 5, and it is possible to slightly enlarge the distance between the recording paper supporting portions 152 and 162 of the supporting members 148 and 158. The pair of supporting members 148 and 158 constitute recording paper holding means for holding the roll of recording paper 82.

The roll of recording paper 82 mounted on the recording paper holding means of the open/close cover 32 has the structure shown in FIGS. 3 and 5. That is, the roll of recording paper 82 includes a long and narrow cylindrical core member 170, and the recording paper 100 is wound around an outer peripheral surface of this core member 170 many times. The core member 170 is formed of relatively hard paper, and its center is hollow. The length of the core member 170 in its axial direction is substantially equal to the width of the recording paper 100 (the length in the axial direction when the recording paper 100 is wound in the roll-like manner). Therefore, in a state in which the recording paper 100 is wound around the core member 170, both the end surfaces define substantially the same end surfaces (see FIGS. 5 and 7).

In the present embodiment, the recording apparatus is further structured as follows. Referring to FIG. 7, an outer diameter of each of the first projections 164 of the supporting members 148 and 158 is set slightly smaller than that of the core member 170 of the roll of recording paper 82. Each of the second projections 166 of the supporting members 148 and 158 is set substantially equal to or slightly smaller than an inner diameter of a hollow hole 170 of the core member 170. Therefore, the second projections 166 can be inserted into and removed from the hollow hole 170 of the core member 170. Further, the length of the core member 170 in its axial direction is set slightly longer than the distance between the first projections 164 of the supporting members 148 and 158. Therefore, if the roll of recording paper 82 is mounted, the opposite end surfaces of the core member 170 act on the tip end surface of the second projection 166, so that the supporting members 148 and 158 are slightly deformed toward opposite sides.

Next, the attaching procedure of the roll of recording paper 82 will be explained. When the roll of recording paper 82 is mounted (for example, when a new roll of recording paper 82 is mounted in case that the recording apparatus is used), the open/close cover 32 is positioned from the close position (the position shown in FIGS. 1 to 3, and shown with the solid line in FIG. 6) to the open position (the position shown in FIG. 4, and shown with the phantom line 32B in FIG. 6). Such a positioning can be done by bringing up the front wall 110 of the open/close cover 32 for example, and the open/close cover 32 is pivoted on the pivot 124.

When the open/close cover 32 is positioned at the open position, the inside of the open/close cover 32 is opened outward as shown in FIG. 4, and a space for mounting the roll of recording paper 82 is generated between the open/close cover 32 and the second print means 72. In the present embodiment, the cutter unit 88 is mounted on the print unit 78 of the second print means 72 such that the cutter unit 88 can pivot between a close position (the position shown in FIG. 3) and an open position (the position shown in FIG. 4). This cutter unit 88 is normally held at the close position for cutting the recording paper 100 from the roll of recording paper 82, but when the roll of recording paper 82 is to be mounted, the cutter unit 88 is positioned at the open position. If the cutter unit 88 is positioned at the open position, the space between the print unit 78 and the cutter unit 88 is opened as shown in FIG. 4. Further, if the open/close cover 32 is positioned at the open position, the front surface of the upper housing 6 is opened, so that the ribbon cassette 64 can be detachably mounted on the print unit 60.

Next, in a state in which the open/close cover 32 is opened, as shown in FIG. 5, the operation portion 154 of the supporting member 148 is moved in the direction shown with the arrow 168 to enlarge the distance between the recording paper supporting portions 152, 162 of the supporting members 148, 158. In a state in which the distance is enlarged in this manner, the second projections 166 of the supporting members 148 and 158 are positioned in the hollow hole 172 of the core members 170 of the roll of recording paper 82 (see also FIG. 7) and then, the resilient deformation of the supporting member 148 by the operation portion 154 is released. With this operation, the second projections 166 of the supporting members 148 and 158 are inserted to the core member 170 as shown in FIGS. 5 and 7, the roll of recording paper 82 is supported by the second projections 166 of the supporting members 148 and 158, and the roll of recording paper 82 is held rotatably about the rotation axis 167 of the second projections 166 as its rotation axis. In such a holding state, since the distance between the first projections 164 of the supporting members 148 and 158 is set slightly smaller than the length of the core member 170, the tip end surfaces of the first projections 164 are contacted under pressure with the end surfaces of the core member 170 by the resilient effect of the supporting members 148 and 158, the braking force is applied to the rotation of the roll of recording paper 82 when the recording paper 100 is pulled out, and the slack of the pulled out recording paper 100 is prevented from being generated. In the present embodiment, the first projections 164 of the supporting members 148 and 158 function as the braking force applying means, and act on the core member 170 of the roll of recording paper 82. Although the recording paper 100 of the roll of recording paper 82 is reduced as it is used, the diameter of the core member 170 is not varied. Therefore, because the first projections 164 function as described above, the constant braking force is applied irrespective of the service condition of the recording paper 100. When the braking force is not largely varied by the service condition of the recording paper 100, the tip end surfaces of the first projections may be contacted under pressure with the end surfaces of the core member 170 and the recording paper 100.

In the present embodiment, in order to facilitate the attaching and detaching operation of the roll of recording paper 82, the tip ends of the second projections 166 of the supporting members 148 and 158 are provided with first and second inclining portions 166*a* and 166*b*, respectively. As shown in FIG. 7, the first inclining portion 166*a* is extended such as to incline upward and inward when the open/close cover 32 is at the close position, the pair of the supporting members 148 and 158 can be resiliently deformed outside by moving the core member 170 of the roll of recording paper 82 along the first inclining portions 166*a* of the second projections 166, and with this operation, the roll of recording paper 82 can easily be mounted on the second projections 166. The second inclining portion 166*b* is extended such as to incline downward and inward when the open/close cover 32 is at the close position, and by utilizing the second inclining portion 166*b*, the roll of recording paper 82 (the core member 170 when the recording paper 100 is run out)

can easily be detached from the space between the second projections 166. In this embodiment, since the easiness of the attaching operation of the roll of recording paper 82 takes priority, the first inclining portion 166*a* is extended over the rotation axis 167, and is formed larger than the second inclining portion 166*b*. The roll of recording paper 82 (or the core member 170) can be detached by pushing the operation portion 154 of the supporting member 148 outward, thereby enlarging the distance between the supporting members 148 and 158.

Thereafter, as understood in FIG. 3, the tip end of the recording paper 100 is pulled from the roll of recording paper 82 and introduced out from the discharge port 98 through the second conveying path 80 and then, the open/close cover 32 is pivoted to be positioned to the close position. The print head 74 and the platen roller 76 are designed such that the contact-under pressure state can be released. When the recording paper 100 is inserted through the space between the print head 74 and the platen roller 76, the contact-under pressure state is released, and the tip end of the recording paper 100 is inserted therebetween. In this recording apparatus, since the pivot of the open/close cover 32 and the rotation axis of the roll of recording paper 82 substantially coincide with each other, even if the open/close cover 32 is pivoted from the open position to the close position, and vice versa, the moment force acting on the open/close cover 32 of the roll of recording paper 82 is substantially zero, and the roll of recording paper 82 is only pivoted on the pivot of the open/close cover 32. Therefore, the open/close cover 32 can smoothly be pivoted irrespective of the pivoting angle. Further, when the open/close cover 32 is opened or being closed, the pivoting moment of the open/close cover 32 should not largely varied, and the safety during opening or closing operation is secured.

Figure 9A:
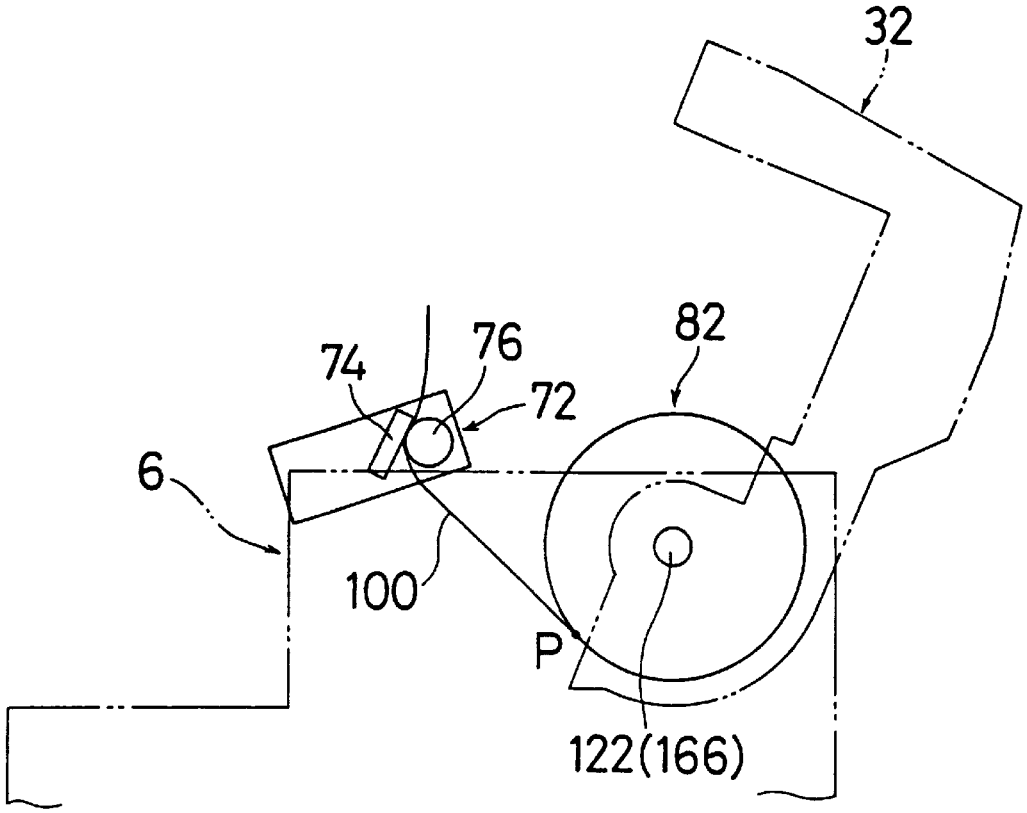
FIGS. 9A and 9B are schematic explanatory views for explaining the rewinding operation of the recording paper by pivoting movement of the open/close cover in its closing direction.
Figure 9B:
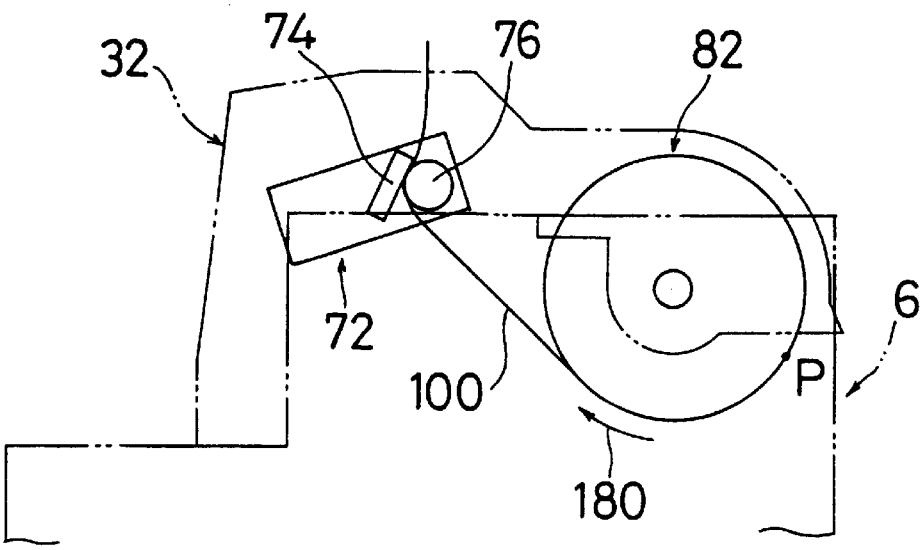

In the present embodiment, the slack of the recording paper of the roll of recording paper 82 can be taken up by the pivoting movement of the open/close cover 32 in its closing direction. Mainly referring to FIG. 9, the present embodiment will be further explained. The roll of recording paper 82 is prevented from freely rotating relative to the open/close cover 32 by the effect of the braking force applying means provided on the open/close cover 32 (see FIG. 5), and the roll of recording paper 82 is pivoted on the pivot in unison with the pivoting movement of the open/close cover 32. When the roll of recording paper 82 is pivoted on the pivot in this manner, a point P of the roll of recording paper 82 (a point from which the recording paper 100 is pulled out) (see FIG. 9A) when the open/close cover 32 is at the close position, is moved to a position shown in FIG. 9B when the open/close cover 32 is pivoted to the close position, the roll of recording paper 82 held by the open/close cover 32 is rotated in a direction to rewind the pulled out recording paper 100. Therefore, the slack recording paper 100 between the roll of recording paper 82 and the second print means 72 (the print head 74 and the platen roller 76) is rewound around the roll of recording paper 82 by the above-described movement of the roll of recording paper 82, and the slack of the recording paper 100 is taken up. Especially in this embodiment, since the pivot 124 of the open/close cover 32 and the rotation axis 167 of the roll of recording paper 82 substantially coincide with each other, the roll of recording paper 82 is reliably moved in the rewinding direction by the pivoting movement of the open/close cover 32 in the close position, its moving amount corresponds to the pivoting angle between the open position and the close position of the open/close cover 32 and therefore, the recording paper 100 can be rewound around the roll of recording paper 82.

In this recording apparatus, the nip force to the recording paper 100 applied by the print head 74 of the second print means 72 and the platen roller 76 (which constitutes the opposing member pushed against the print head 74) is set greater than the braking force applied by the braking force applying means. By setting the braking force in this manner, when the slack amount of the recording paper 100 is small, after the slack of the recording paper 100 is taken up, the roll of recording paper 82 is slightly rotated in the direction shown with the arrow 180 (FIG. 9B) relative to the open/close cover 32 about the rotation axis 167, great tensile force is not applied to the recording paper 100 pulled out from the roll of recording paper 82, and the nip condition of the recording paper 100 between the print head 74 and the platen roller 76 is maintained.

The above-described embodiment is designed such that the tip end of the recording paper 100 introduced out from the roll of recording paper 82 is first nipped by the print head 74 of the second print means 72 and the platen roller 76 and therefore, the nip force by the print head 74 and the platen roller 76 is related, but when the recording paper 100 from the roll of recording paper 82 is designed to be nipped by a pair of conveying rollers, nip force by the pair of conveying rollers is related. That is, in such a case, the nip force by the conveying rollers is set greater than the braking force by the braking force applying means, and with such a structure, the same effect as that described above is achieved.

Next, with reference to FIGS. 1, 3, 4 and 10, the sheet detecting means 44 and a structure related thereto will be explained. As shown in FIG. 3, the sheet detecting means 44 is disposed outside the open/close cover 32. In the embodiment, the sheet detecting means 44 comprises a combination of light-emitting means 45 comprising a light-emitting element and light-receiving means 47 comprising a light-receiving element. The light-emitting means 45 is disposed above the insertion/discharge port 58 of the first conveying path 70, and the light-receiving means 47 is disposed below the insertion/discharge port 58. When the slip 12 exists in the insertion/discharge port 58, light from the light-emitting means 45 does not reach the light-receiving means 47, and the sheet detecting means 44 detects the slip 12. In this embodiment, the light-emitting means 45 is disposed above the insertion/discharge port 58, and the light-receiving means 47 is disposed below the insertion/discharge port 58. On the contrary, the light-emitting means 45 may be disposed below the insertion/discharge port 58, and the light-receiving means 47 may be disposed above the insertion/discharge port 58. Further, although transmission type detecting means is used as the sheet detecting means 44 in this embodiment, reflection type detecting means may be used instead. In this case, the light-emitting means and the light-receiving means are disposed above the insertion/discharge port 58.

Figure 10:
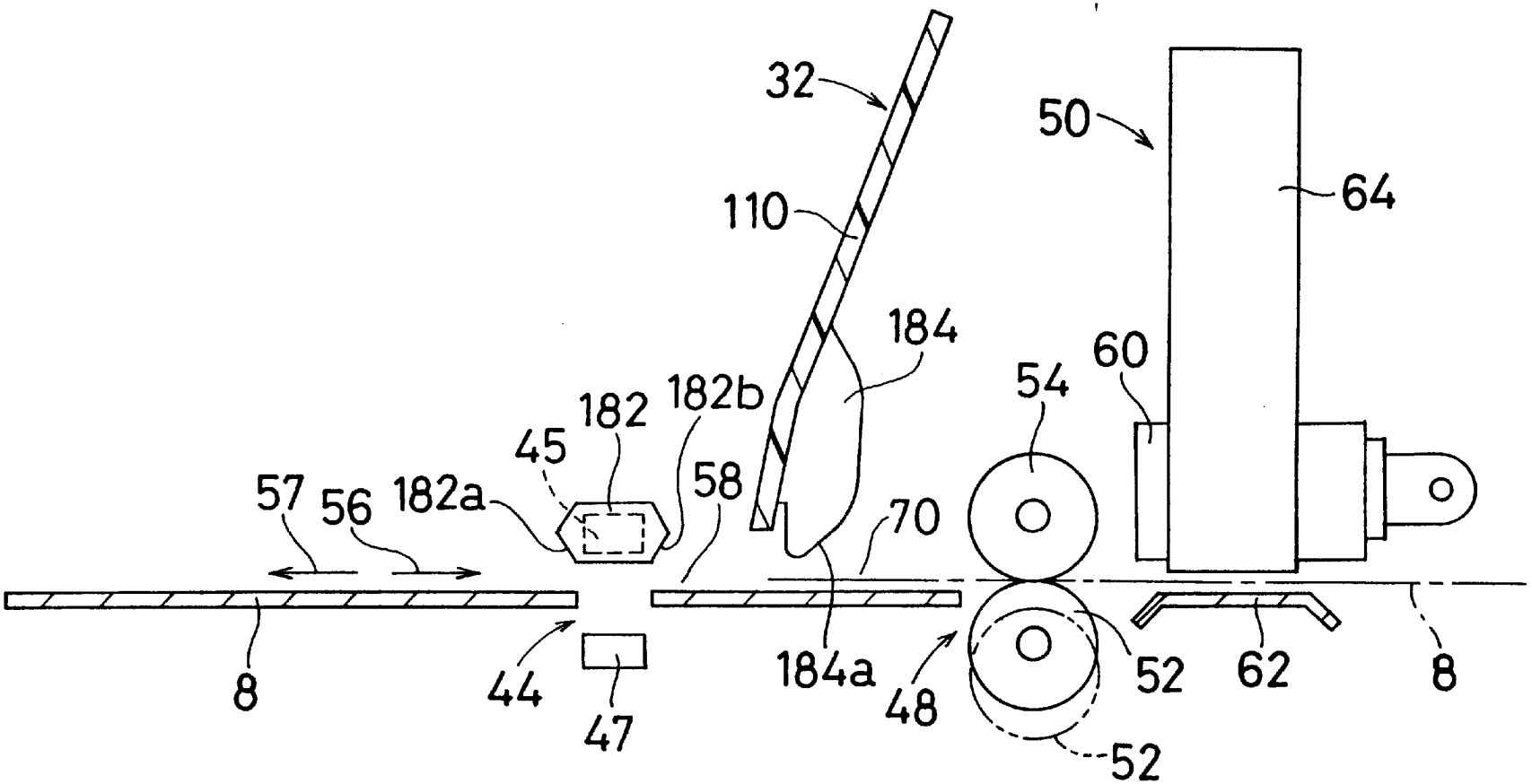
FIG. 10 is a partially enlarged sectional view showing sheet detecting means and its periphery of the recording apparatus shown in FIG. 1.

The light-emitting means 45 is mounted on a sensor cover 182 mounted on the lower housing 4. The sensor cover 182 is provided at its lower end with first and second inclining surfaces 182*a* and 182*b*. As shown in FIG. 10, the first inclining surface 182*a* is extended such as to incline straightly downward in the inserting direction shown with the arrow 56 for introducing, to the space below the sensor cover 182, i.e., below the light-emitting means 45, the slip 12 moving on the table 8 toward the first conveying path 70 in the inserting direction 56. The second inclining surface 182*b* is extended such as to incline straightly downward in the discharging direction shown with the arrow 57 for introducing, to the space below the sensor cover 182, the slip 12 moving on the table 8 out from the apparatus body 2 in the discharging direction 57. Since the sensor cover 182 is provided with the first and second inclining surfaces 182*a* and 182*b*, the slip 12 is passed below the sensor cover 182 and reliably conveyed.

The open/close cover 32 is provided with a guide rib 184 for introducing the slip 12 below the sensor cover 182 as shown in FIGS. 3 and 10. In the embodiment, the guide rib 184 is integrally formed on an inner surface of a tip end (end opposed to the table 8 when the open/close cover is held at the close position) of the front wall 100 of the open/close cover 32. The guide rib 184 projects slightly downward from the tip end of the front wall 100, a lower end of the guide rib 184 is provided with an inclining guide surface 184*a* straightly extended downward in the discharging direction shown with the arrow 57, and a tip end of the inclining guide surface 184*a* is formed into an arc round shape. This guide rib 184 is disposed on a right portion of the front wall 110 of the open/close cover 32 in correspondence with the sheet detecting means 44, and when the open/close cover 32 is at the close position, the guide rib 184 is located above the first conveying path 70 between the sensor cover 182 and the pair of conveying rollers 48 to define a portion of an upper side of the conveying path 70 for guiding the slip 12 moving in the discharging direction shown with the arrow 57 toward the space below the sensor cover 182. The first conveying path 70 may be provided with a plurality of guide ribs 184 at a distance from one another in its widthwise direction. Alternatively, the tip end of the front wall 110 may be partially extended to form a guide rib.

At the inner side of the open/close cover 32, the first print means 50 is disposed in the vicinity of the open/close cover 32. Therefore, when the open/close cover 32 is at the close position as shown in FIG. 3, the open/close cover 32 covers the first print means 50 and the like, and when the open/close cover 32 is positioned at the open position, the front surface side of the first print 50 is largely exposed outside as shown in FIG. 4. Therefore, the ribbon cassette 64 can be detachably mounted on the print unit 60 through this opened front surface, and the ribbon cassette 64 can easily be replaced by new one. When a new ribbon cassette 64 is mounted, the open/close cover 32 is positioned to the open position, the lower conveying roller 52 is positioned to a non-service position shown with the phantom line in FIG. 10, a ribbon 64*a* of the ribbon cassette 64 is inserted through between the pair of conveying rollers 48 whose nip condition is released, thereby mounting the new ribbon cassette 64. In this recording apparatus, as understood in FIG. 10, a distance between the sheet detecting means 44 and the first print means 50 is set relatively large, and related thereto, a distance between the sheet detecting means 44 and the pair of conveying rollers 48 is also large. Therefore, utilizing the large distance between the sheet detecting means 44 and the pair of conveying rollers 48, the ribbon cassette 64 can easily be attached and detached. The pair of rollers 48 is disposed close to the center of the print unit 60 as shown in FIG. 4 so that the ribbon cassette 64 is not prevented from being inserted.

Referring again to FIG. 4, a lock member 186 for locking the open/close cover 32 at the close position will be explained. The lock member 186 is provided such as to further project from a right end of the front wall 100 of the open/close cover 32, and a tip end of the lock member 186 is integrally formed with an engaging pawl 186*a*. On the other hand, the lower housing 4 is provided with an engaging hole 188 in the vicinity of the operation panel 16. When the open/close cover 32 is pivoted to the close position on the pivot 124, the engaging pawl 186*a* of the lock member 186 engages the engaging hole 188, and the open/close cover 32 is held at the close position. When the open/close cover 32 is opened, the lock member 186 is pushed to release the engaging state between the engaging pawl 186*a* and the engaging hole 188 and then, the open/close cover 32 is pivoted to the open position.

In the above-described recording apparatus, the slip 12 is printed as follows. Mainly referring to FIGS. 3 and 10, the slip 12 is placed on the table 8 and positioned at a position where the sheet detecting means 44 detects the slip 12. The slip 12 can be positioned on the table 8 through the slit 10 from the side of the apparatus body 2, or can directly be positioned from the front surface side of the apparatus body 2. When the slip 12 is placed from the front surface side of the apparatus body 2, since the first inclining surface 182*a* of the sensor cover 182 functions as a guide surface, the tip end of the slip 12 can reliably be introduced into the first conveying path 70 through the space below the sensor cover 182. When this slip 12 is inserted from the front surface side, it is inserted until it abuts against the pair of conveying rollers 48.

Figure 11:
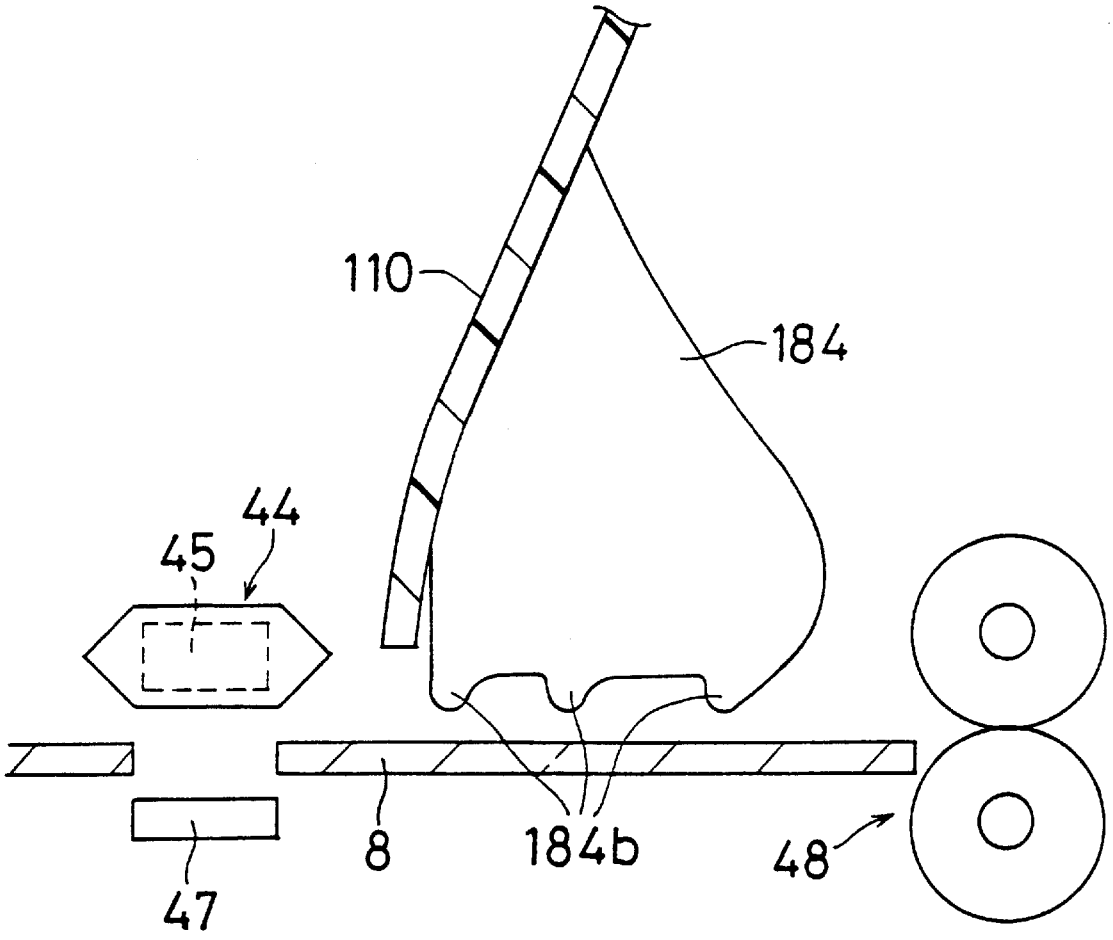
FIG. 11 is an enlarged sectional view showing the sheet detecting means and its periphery of a recording apparatus provided with a guide rib of a modification.

Next, the switch 18 of the operation panel 16 is pushed. By pushing the switch 18 of the operation panel 16, the printing operation on the slip 12 is started, the conveying pair of rollers 48 is first rotated in the predetermined direction shown with the arrow, and the slip 12 on the table 8 is conveyed in the inserting direction shown with the arrow 56 by the operation of the pair of conveying rollers 48. When the rear end of the slip 12 in the inserting direction passes through the sheet detecting means 44, after a predetermined time period is elapsed from this time point, the pair of conveying rollers 48 is rotated reversely. This predetermined time period is set, e.g., to a time that is required before the rear end of the slip 12 in the inserting direction is conveyed to a position immediately before the nip portion of the pair of conveying rollers 48. When the predetermined time period is set to such a time, non-recordable region on which print can not be recorded on the slip 12 is reduced, and the recording limitation on the slip 12 is reduced. Alternatively, the predetermined time period can be set to a time that is required before the slip 12 in the inserting direction is conveyed to a position immediately before the rear end of the slip 12 passes the top of the guide rib 184. When the predetermined time period is set to such a time, although non-recordable region of the slip 12 is slightly increased, since the rear end of the slip 12 in the inserting direction, i.e., leading tip end of the slip 12 in the discharging direction is located below the guide rib 184, the slip 12 can reliably be conveyed toward the insertion/discharge port 58, and the paper jam in the vicinity of the guide rib 184 can be prevented. In order to reduce the non-recordable region of the slip 12, the guide rib 184 may be disposed in the vicinity of the pair of rollers 48 in FIG. 10. Further, if the guide rib 184 is shaped such that the top portion thereof is long in the conveying direction, the non-recordable region can be reduced, and the paper jam can reliably be prevented. In such a case, it is preferable that the top portion is partially provided with projections 184*b* as shown in FIG. 11 so as to reduce the load of the paper conveying operation.

While the pair of conveying rollers 48 rotates reversely and the slip 12 is conveyed in the discharging direction shown with the arrow 57, the predetermined print is recorded on the slip 12 by the first print means 50, and the slip 12 after printing is discharged out from the apparatus body 2 through the insertion/discharge port 58. When the slip 12 is conveyed in the discharging direction, the leading end of the slip 12 in the discharging direction is guided by the guide inclining surface 184*a* of the guide rib and introduced to the space below the sensor cover 182, guided by the second inclining surface 182*b* of the sensor cover 182, discharged through the space below the second inclining surface 182*b*.

In this recording apparatus, since the open/close cover 32 is provided with the guide rib 184, when the open/close cover 32 is positioned at the open position, the guide rib 184 is largely distanced from the front portion of the first print means 50 and located above the first print means 50. Therefore, the space at the front surface of the first print means 50 and the space between the sheet detecting means 44 and the pair of conveying rollers 48 are opened, and the ribbon cassette 64 can easily be replaced through the space. Further, when the open/close cover 32 is positioned at the close position, the guide rib 184 is located above the space between the sheet detecting means 44 and the pair of conveying rollers 48 to define a portion of the first conveying path 70. Therefore, even if the slip 12 is curved, the discharge direction end of the slip 12 is introduced to the space below the sheet detecting means 44 by the operation of the guide rib 184, the slip 12 should not be conveyed above the sheet detecting means 44 in the curved state, and the paper jam in the vicinity of the sheet detecting means 44 is prevented.

Although the embodiment of the recording apparatus according to the present invention has been described above, the invention should not be limited to this embodiment, and it is possible to variously change or modify without departing from the scope of the invention.

For example, although the pair of supporting members 148 and 158 are mounted on the open/close cover 32, and the supporting members 148 and 158 are provided with the recording paper supporting portions 152 and 162 in the illustrated embodiment, one of or both of the supporting members 148 and 158 may be omitted, and one of or both of the recording paper supporting portions 152 and 162 may directly be mounted on the inner surfaces of the side walls 116 and 118 of the open/close cover 32.

Further, for example, although the illustrated embodiment has been explained based on the recording apparatus including the first print means 50 for printing on the slip 12 and the second print means 72 for printing on the recording paper of the roll of recording paper 82, the invention related to the roll of recording paper 82 can also be applied to a recording apparatus including only print means for printing on the recording paper of the roll of recording paper 82 of course.

Further, for example, although the illustrated embodiment has been explained based on the recording apparatus including the first printing means 50 for printing on the slip 12 and the second print means 72 for printing on the recording paper of the roll of recording paper 82, the invention related to the sheet of recording paper (slip 12) can also be applied to a recording apparatus including only print means for printing on the sheet of recording paper of course. Further, although the sheet detecting means 44 is disposed outside the open/close cover 32, the sheet detecting means 44 can also be disposed inside the open/close cover 32, and in such a case, the guide rib 184 may be positioned between the sheet detecting means 44 and the pair of conveying rollers 48.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, the recording apparatus of the present invention related to the roll-like recording paper is useful as an apparatus for recording on a single strip such as an order slip, a receipt slip and the like, and on the roll-like recording paper utilized for a receipt and the like, and is also useful as a facsimile and a printer and the like for preparing a receipt and the like. Further, the recording apparatus of the invention related to the sheet of recording paper is useful as an apparatus for recording on a slip and roll-like recording paper, and is also useful as an exclusive apparatus for recording on a slip.

We claim:

1. A recording apparatus comprising:

an apparatus body;

an open/close cover mounted on the apparatus body so as to pivot between an open position and a close position on a pivot thereof;

a conveying path provided in the apparatus body;

a roll of recording paper supported by the open/close cover rotatably about a rotation axis thereof, recording paper from the roll of recording paper being conveyed through the conveying path; and recording means for recording information on the recording paper conveyed through the conveying path, wherein the open/close cover is provided with braking force applying means for applying braking force to the roll of recording paper, and the roll of recording paper is pivoted in unison with the open/close cover by an effect of the braking force applying means when the open/close cover is pivoted from the open position to the close position, whereby the roll of recording paper is rotated in a direction for rewinding the recording paper pulled out therefrom.

2. The recording apparatus of claim 1, wherein the open/close cover is provided with recording paper holding means for supporting the roll of recording paper rotatably about a rotation axis thereof extending substantially in parallel to the pivot, and the pivot of the open/close cover and the rotation axis of the roll of recording paper substantially coincide with each other.

3. The recording apparatus of claim 1, wherein the roll of recording paper comprises a core member and recording paper wound therearound, and the braking force applying means acts on the core member to apply the braking force to the roll of recording paper.

4. The recording apparatus of claim 1, wherein the recording means includes a print head and an opposing member to be pushed against the print head, and nip force of the recording paper by the print head and the opposing member is greater than the braking force applied to the roll of recording paper by the braking force applying means.

5. A recording apparatus comprising:

an apparatus body;

an open/close cover mounted on the apparatus body so as to pivot between an open position and a close position on a pivot thereof;

a conveying path provided in the apparatus body;

a roll of recording paper to be conveyed through the conveying path; and recording means for recording information on the recording paper conveyed through the conveying path, wherein the roll of recording paper is supported by the open/close cover rotatably about a rotation axis thereof extending substantially in parallel to the pivot, and the pivot of the open/close cover and the rotation axis of the roll of recording paper substantially coincide with each other.

6. The recording apparatus of claim 5, wherein the open/close cover is provided with a discharge opening for discharging the recording paper of the roll of recording paper conveyed through the conveying path, and a guide rib for guiding the recording paper discharged through the discharge opening outside of the apparatus body.

7. A recording apparatus comprising:

an apparatus body;

a conveying path defined in the apparatus body;

conveying means for conveying a sheet of recording paper in an inserting direction and a discharging direction opposite from the inserting direction through an insertion/discharge port provided at one end of the conveying path;

recording means disposed in the conveying path, for recording on the sheet of recording paper conveyed through the conveying path; and sheet detecting means for detecting the sheet of recording paper, wherein the sheet detecting means is disposed above the insertion/discharge port, the sheet of recording paper being inserted into and discharged from the conveying path passing below the sheet detecting means, the apparatus body is provided with an open/close cover which can pivot between a close position and an open position on a pivot thereof, the open/close cover being provided with a guide rib for guiding the sheet of recording paper, and when the open/close cover is held at the close position, the guide rib is located above the insertion/discharge port in a vicinity thereof to define a portion of the conveying path, and introduces the sheet of recording paper conveyed in the discharging direction through the conveying path below the sheet detecting means.

8. The recording apparatus of claim 7, wherein the recording means is disposed inside the open/close cover in a vicinity thereof, the sheet detecting means is disposed outside the open/close cover, and when the open/close cover is pivoted to the open position, the apparatus body is partially opened, whereby the recording means is largely exposed outside, and when the open/close cover is pivoted to the close position, the recording means is covered with the open/close cover and the guide rib of the open/close cover defines the portion of the conveying path between the recording means and the sheet detecting means.

9. The recording apparatus of claim 7, wherein the guide rib is provided with an inclining guide surface downwardly inclining in the discharging direction, and the sheet of recording paper conveyed in the discharging direction is guided by the inclining guide surface and introduced below the sheet detecting means.

10. The recording apparatus of claim 7, wherein the sheet detecting means comprises a combination of light-emitting means for emitting light and light-receiving means for receiving light from the light-emitting means, one of the light-emitting means and the light-receiving means is disposed above the insertion/discharge port, while the other of the light-emitting means and the light-receiving means is disposed below the insertion/discharge port, the one of the light-emitting means and the light-receiving means is covered with a sensor cover, and the sensor cover is provided at a lower end thereof with a first inclining surface for introducing the sheet of recording paper moved in the inserting direction below the sensor cover, and a second inclining surface for introducing the sheet of recording paper moved in the discharging direction below the sensor cover.

* * * * *